US006142111A

United States Patent [19]

Leijonberg

[11] Patent Number: 6,142,111

[45] Date of Patent: Nov. 7, 2000

[54] POWER MACHINE

[75] Inventor: Gunnar Leijonberg, Huskvarna, Sweden

[73] Assignee: Gul & Co Development AB, Huskvarna, Sweden

[21] Appl. No.: 09/228,284

[22] Filed: Jan. 11, 1999

Related U.S. Application Data

[63] Continuation of application No. PCT/SE97/01262, Jul. 10, 1997.

[30] Foreign Application Priority Data

Jul. 12, 1996 [SE] Sweden ..... 9602760

[51] Int. Cl.[7] ..... F01B 9/06; F02B 75/32

[52] U.S. Cl. ..... 123/51 B

[58] Field of Search ..... 123/51 B, 51 A, 123/51 R, 52.2, 52.3, 52.5, 53.4, 53.6, 73 R, 73 AF, 73 PP, 74 A

[56] References Cited

U.S. PATENT DOCUMENTS

| | | | |
|---|---|---|---|
| 4,254,745 | 3/1981 | Noguchi et al. | 123/51 B |
| 4,257,365 | 3/1981 | Noguchi et al. | 123/51 B |
| 4,334,506 | 6/1982 | Albert | 123/51 B |
| 4,732,115 | 3/1988 | Lapeyre | 123/51 B |
| 5,083,530 | 1/1992 | Rassey | 123/51 R |

FOREIGN PATENT DOCUMENTS

| | | |
|---|---|---|
| 1 800 103 | 3/1993 | U.S.S.R. . |
| 204220 | 9/1923 | United Kingdom . |

*Primary Examiner*—Marguerite McMahon
*Attorney, Agent, or Firm*—Pillsbury Madison & Sutro LLP

[57] ABSTRACT

The present invention is for the kind of power machines, engines, pumps or compressions which have two or more pistons which work against each other preferably with a common combustion chamber or corresponding, in a stationary cylinder and where the power is transmitted to or from a rotating motion without an intermediate crankshaft. The object of the present invention is to make use of the moments of the pistons for further purpose. According to the invention the motions of the pistons are used to compress gas on that side of the pistons which is turned away from the combustion chamber. Behind each piston, i.e. on the piston rod side of the respective piston, there is a delimited space, (64, 65). Preferably the spaces (64, 65) are arranged so that during certain parts of a cycle of operation they are closed by valves of a suitable kind and during other parts of the cycle of operation are opened and allow inflow or outflow of gas.

4 Claims, 8 Drawing Sheets

POWER MACHINE

This is a continuation of International Appln. No. PCT/SE97/01262 filed Jul. 10, 1997 which designated the U.S.

BACKGROUND OF THE INVENTION

The present invention is for the kind of power machines, engines, pumps or compressors which have two or more pistons which work against each other, preferably with a common combustion chamber in a stationary cylinder and where the power is transmitted to or from a rotating motion without an intermediate crankshaft.

It is an object of the present invention to use the movements of the pistons for further purpose.

In combustion engines the transmission of power from a to and fro (i.e., reciprocating) motion to a rotating motion generally takes place with the use of some kind of crankshaft or the like device. In some cases however crankshafts are less suitable and this is especially the case when to and fro motions of different, often opposite directions together shall be transmitted into a rotating motion. Especially this holds for the kind of power machines i. e. combustion engines, compressors or pumps, where two pistons at the same time work against each other in a common cylinder bore. In this case the use of a crankshaft brings with it complicated mechanical designs in order to put together the power from the two pistons to one common rotating motion. Transmission of power between a to and fro motion and a rotating motion may instead take place by means of a ballbearing which moves in separate tracks and comprises a ball which is surrounded by a ball holder which is mounted to a piston rod or corresponding device for each piston ball for transmission of the linear motion to rotating motion.

One such device has two parallel plane discs, one stationary disc and one relatively thereto rotating disc. In a cylinder which is positioned centrally relative to the discs there are two pistons which are working pistons in a combustion engine and which have a common combustion chamber. Permanently joined to each of the pistons there is a piston rod which in its opposite end has a holder means for the ball by means of which the power from the to and fro motion is transmitted to the rotating disc. The rotating disc is mounted onto a holder which in turn is mounted onto an outgoing shaft from which the rotating power is taken for various purposes. The balls are movable both in linear tracks in the fixed disc and in a common elliptic or otherwise closed shaped track in the rotating disc. In other embodiments the tracks may be substituted for by raised edges which are contacted by for example roller or slide bearings on the sides of the edge.

SUMMARY OF THE INVENTION

According to the invention the motion of the pistons is utilised to compress air or gas on that side of the pistons which is turned away from the combustion chamber. The device according to the invention has the characteristics which are mentioned in claim 1. Further embodiments of the invention has those characteristics which are mentioned in the other claims.

DESCRIPTION OF THE DRAWINGS

The invention will below be described more in detail with reference to the embodiment which is shown in the enclosed figures.

DETAILED DESCRIPTION

Figure 1:
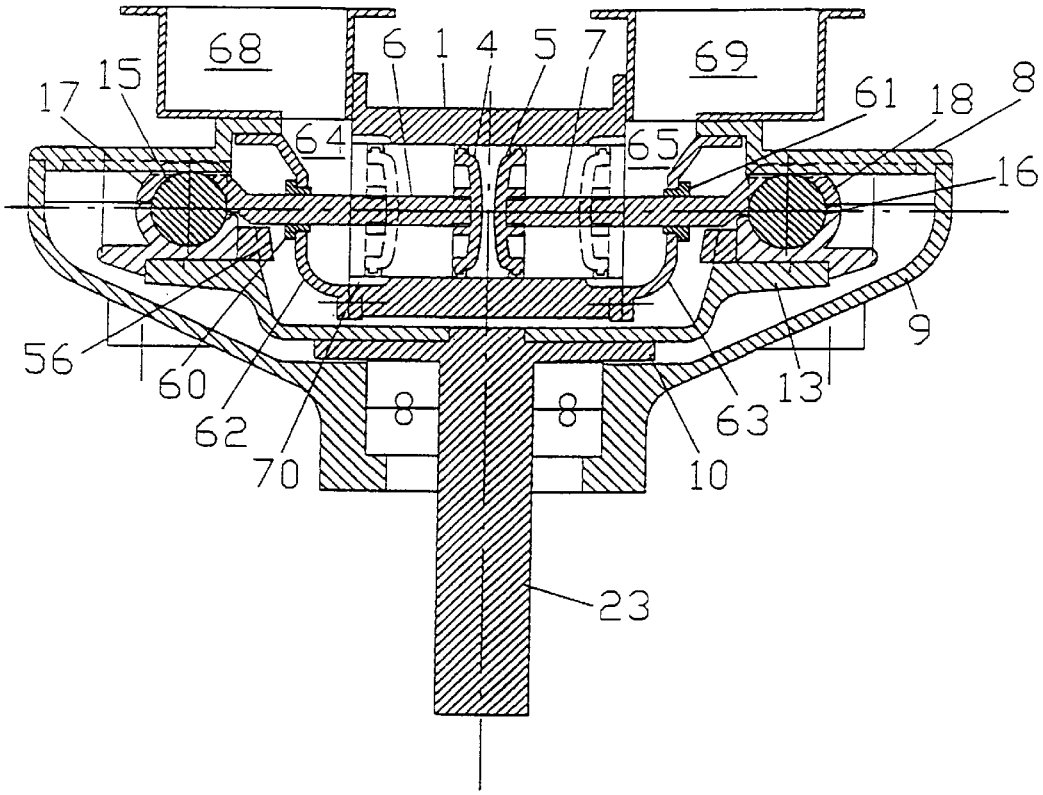
FIG. 1 shows a cross-section of a device according to the invention.

The device shown in the figures has two parallel plane discs, one which is named stationary disc 8 and one relatively thereto rotating disc 13. The stationary disc 8 is mounted to a housing 9 and the disc has positioned in its centre a cylinder 1. In the cylinder there are two pistons 4, 5 which are working pistons and in a combustion engine preferably have a common combustion chamber.

Permanently joined to each of the pistons 4–5 there is a piston rod 6, 7, which at its opposite end has a holder means 17, 18 for the ball 15, 16 by means of which the power from the to and fro motion is transmitted to the rotating disc 13. The balls 15, 16 also serve as bearing between the stationary disc 8 and the rotating disc 13. The rotating disc 13 is mounted to a holder 10 which in turn is mounted to an outgoing shaft 23 from which the rotating power is taken to be used for various purposes. In a preferred embodiment of the invention the centre axis of the cylinder bore coincides with the line of movement of the balls The balls 15, 16 can move both in linear tracks in the fixed disc and in a common elliptic track in the rotating disc.

Figure 2:
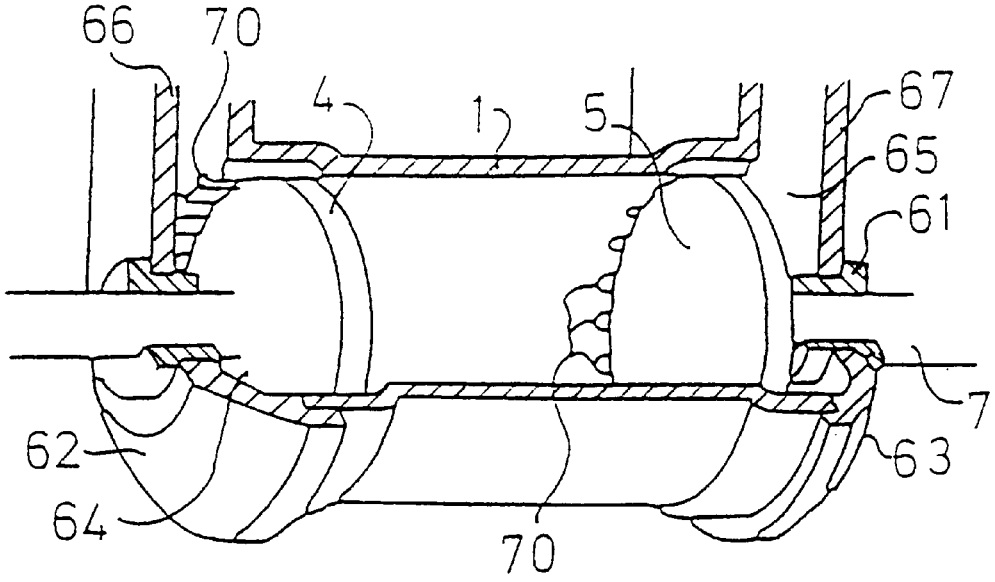
FIG. 2 shows the main parts of the device of FIG. 1 where a part of the cylinder wall has been removed.
Figure 3:
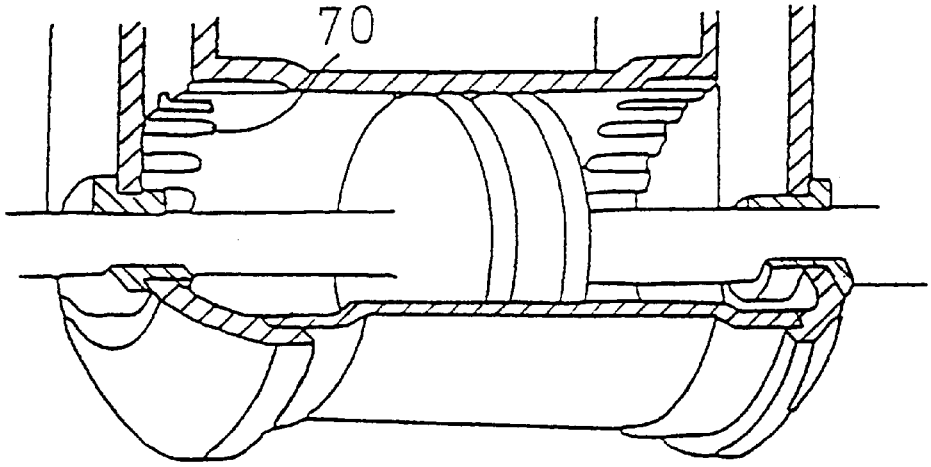
FIG. 3 shows the device of FIG. 2 in another position of operation.

In FIGS. 1 and 3 the device is shown with the pistons in their upper dead centre, UDC. FIG. 2 and a hatched line in FIG. 1 show the pistons in their lower dead centre, LDC. In the embodiment which is shown in the figures the pistons have a common combustion chamber which is placed in the centre. In some embodiments there may however be a dividing wall in the centre of the cylinder so that each of the pistons has its own combustion chamber. In the centre of the cylinder between the upper dead centres of the pistons there are arranged possible valves, spark plugs etc., which do not form a part of the present invention and thus are not shown in FIGS. 1–3. Behind each of the pistons, i. e. at the piston rod side of each piston and outside the extent of movements of the piston there is a limited space 64, 65. Adjacent to this spaces there are channels 66, 67 which delimit further spaces 68, 69 which can be in direct connection with and form a common space with the spaces 64, 65 immediately behind the pistons. The spaces behind the pistons are delimited by end walls 62, 63 in which there are sealing through bushings 60, 61 for the piston rods. In this way the cylinder bore is separated from the power transmitting parts. Preferably the spaces 64 and 65 have means so that they are closed by valves of suitable kind during part of a operation cycle and during other parts of the operation cycle are open and allow inflow and outflow of gas through said valves. In the so delimited and closed spaces behind the pistons the space parts 68, 69 of the channels 66, 67 may be more or less incorporated due to the position of the valves. The closed space behind the pistons can be used for various purposes, and in the embodiment shown in the example of FIGS. 1–3 is used for pre-compression and/or suctioning of air or air-fuel-mixture. If only air is suctioned, fuel is supplied by means of devices, i. e. nozzles, which are arranged in the cylinder or in the air channels.

At both ends of the cylinder around its periphery there are number of inside grooves 70 which have such a length that when the pistons are at their lower dead centres, LDC, there is an open communication between the space between the pistons and the space behind each piston. Air or air-fuel-mixture may then flow into the cylinder. The dimension, number and position of the grooves is adapted to the application in question. In order to obtain favourable conditions of flow and the best possible mixture of air and fuel in the cylinder the grooves may be at some angle relative to the centre axis of the cylinder.

In other applications of the device of the invention it may operate as a compressor and the delimited space 64, 65, 68, 69 behind the pistons can then be used for precompression of gas which will be finally compressed between the pistons.

As no sidewise forces act upon the pistons the need for lubrication of these is small and the lubricant which is needed can be supplied together with the fuel. By the division of the space behind the pistons the cylinder bore is separated from the power transmitting parts and the lubrication system which belongs thereto.

Figure 4:
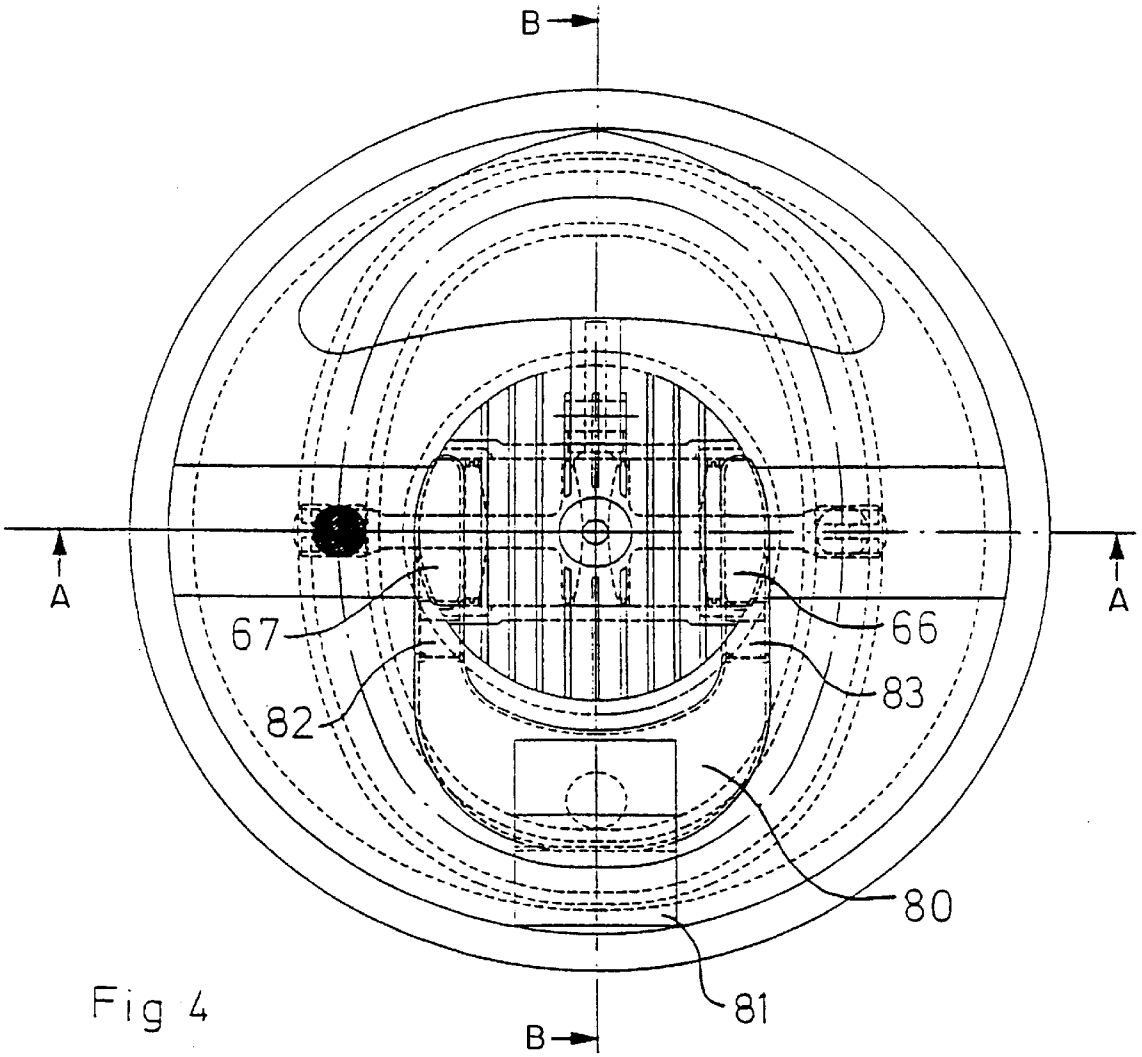
FIGS. 4–6 show an embodiment of the invention for use by a twostroke-engine.
Figure 5:
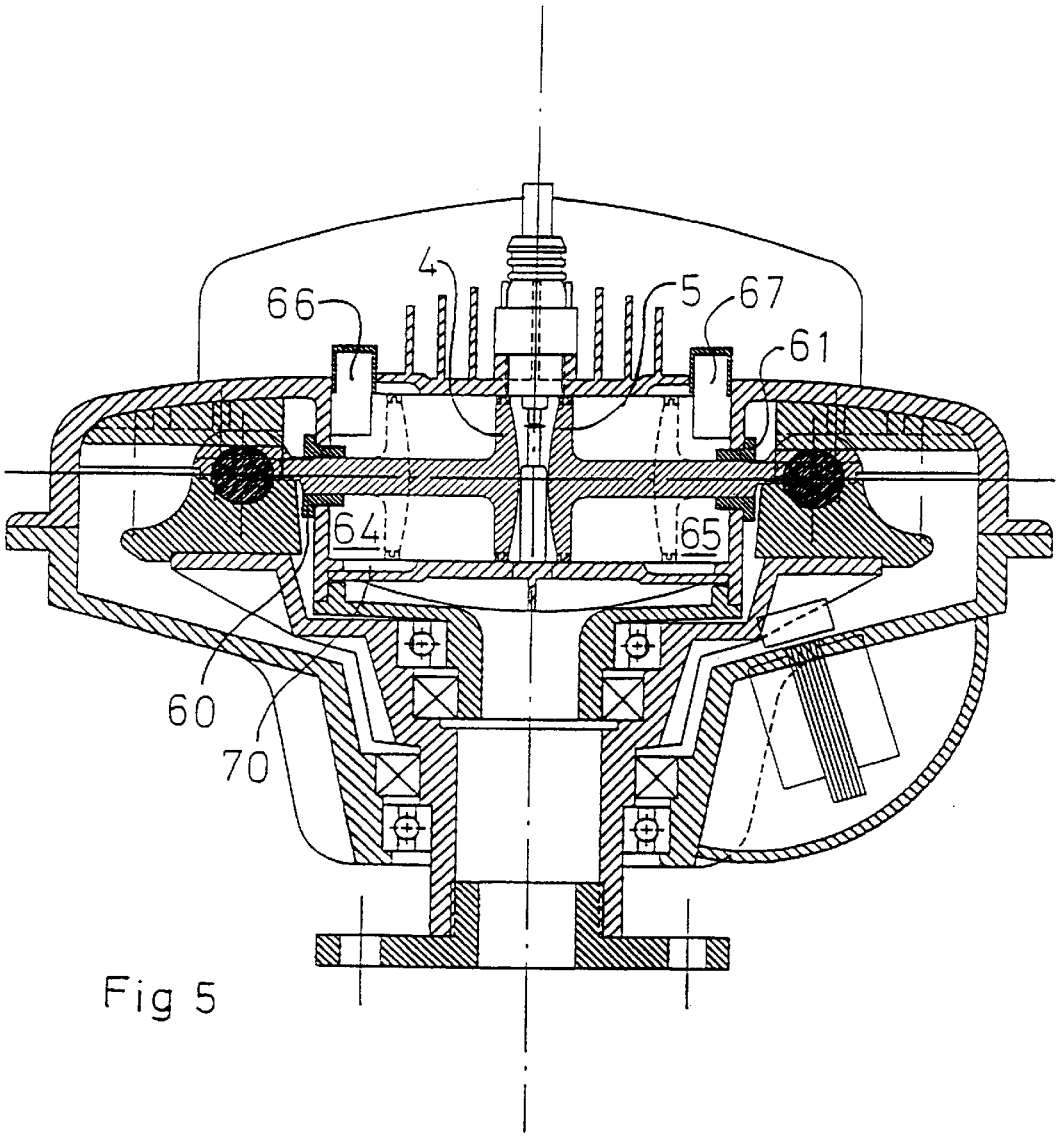
Figure 6:
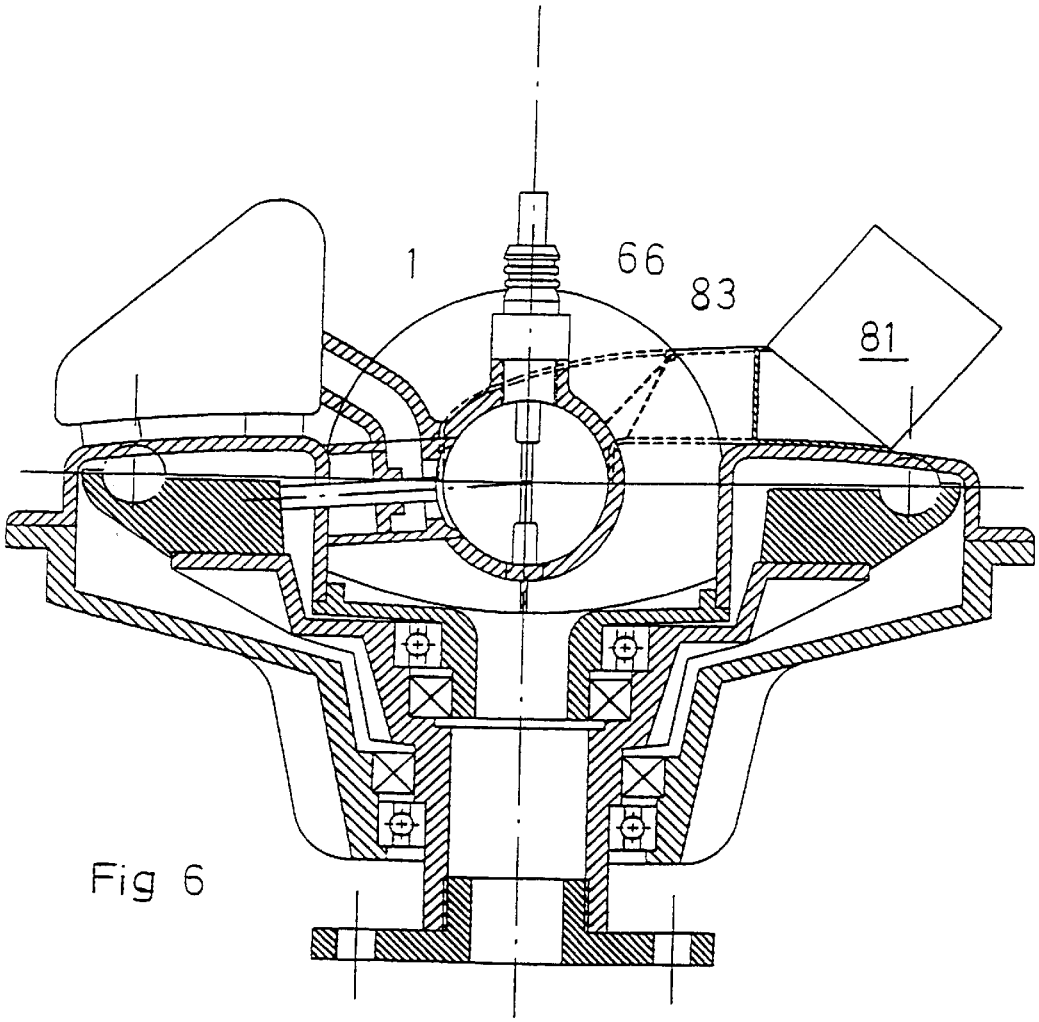

In the FIGS. 4–6 the invention is shown as applied to a port- and valvecontrolled twostroke engine whereby FIGS. 5 and 6 show the engine of FIG. 4 in cross-section in a plane along the lines A—A and B—B respectively. In FIG. 5 the engine is shown with the pistons at UDC and their position at LDC is shown with hatched lines. Behind the pistons there are then limited spaces 64, 65 in connection with the channels 66, 67. The channels are in connection with the surroundings through a common main channel 80 and a filter or carburettor 81. In each channel there is arranged a so called reed-valve 82, 83. In FIG. 6 it is shown with hatched lines the two positions open and closed respectively which are available for the valve 83. When the pistons move from LDC to UDC the space behind them is filled with air which is taken in through the channels and the valves 82, 83 are then open. When the pistons are reversed at UDC and start to move back to LDC the valves are affected so that they close and the air or gas behind the pistons is compressed. When the pistons during their motion reach the grooves 70 in the cylinder wall a connection is opened between the spaces on both sides of the pistons and the compressed gas flows into the space between the pistons where it is mixed with fuel. Fuel injection takes place in the combustion space or in the compressed gas.

Figure 7:
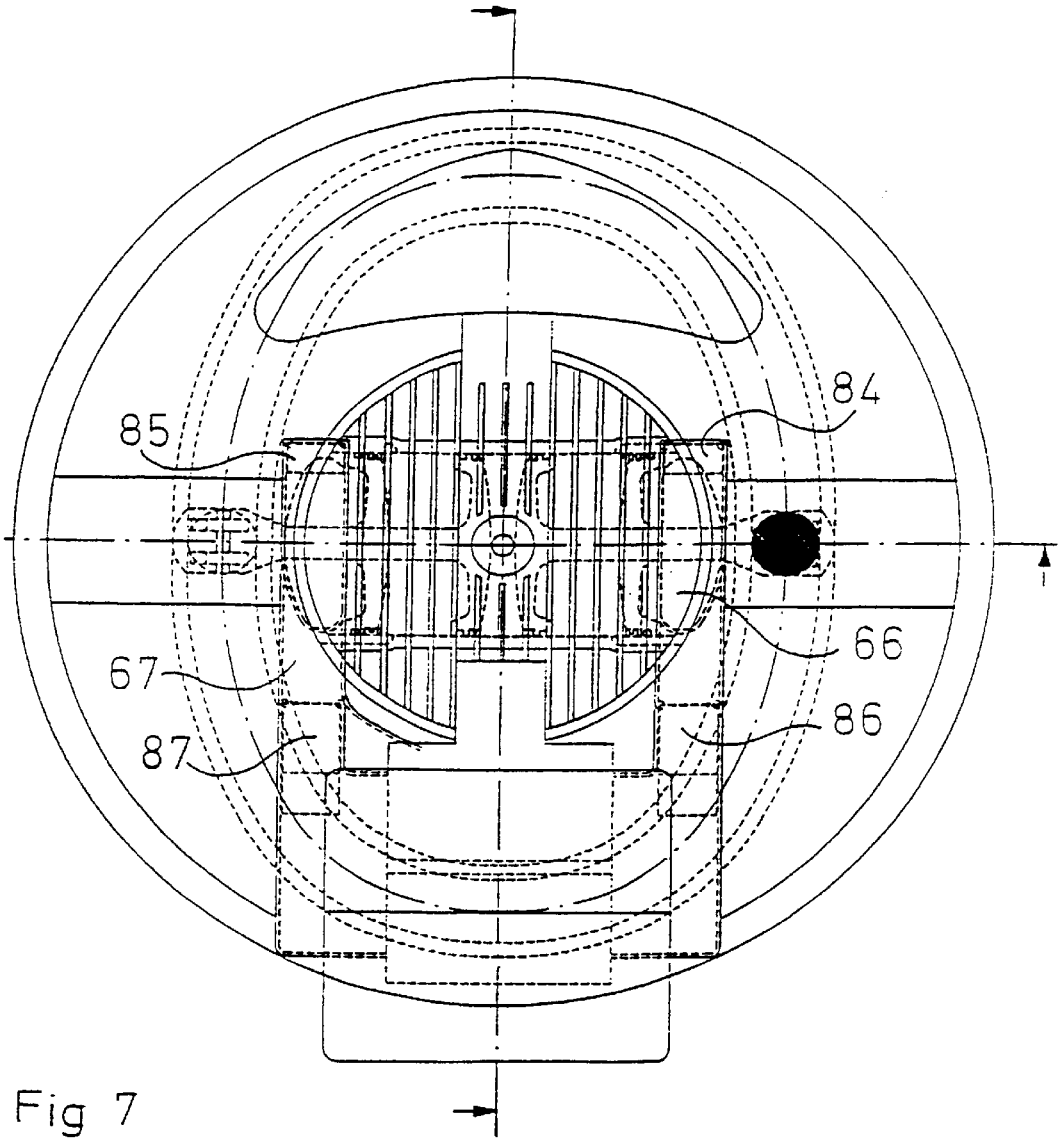
FIGS. 7–9 show an embodiment of the invention for use with a fourstroke-engine.
Figure 8:
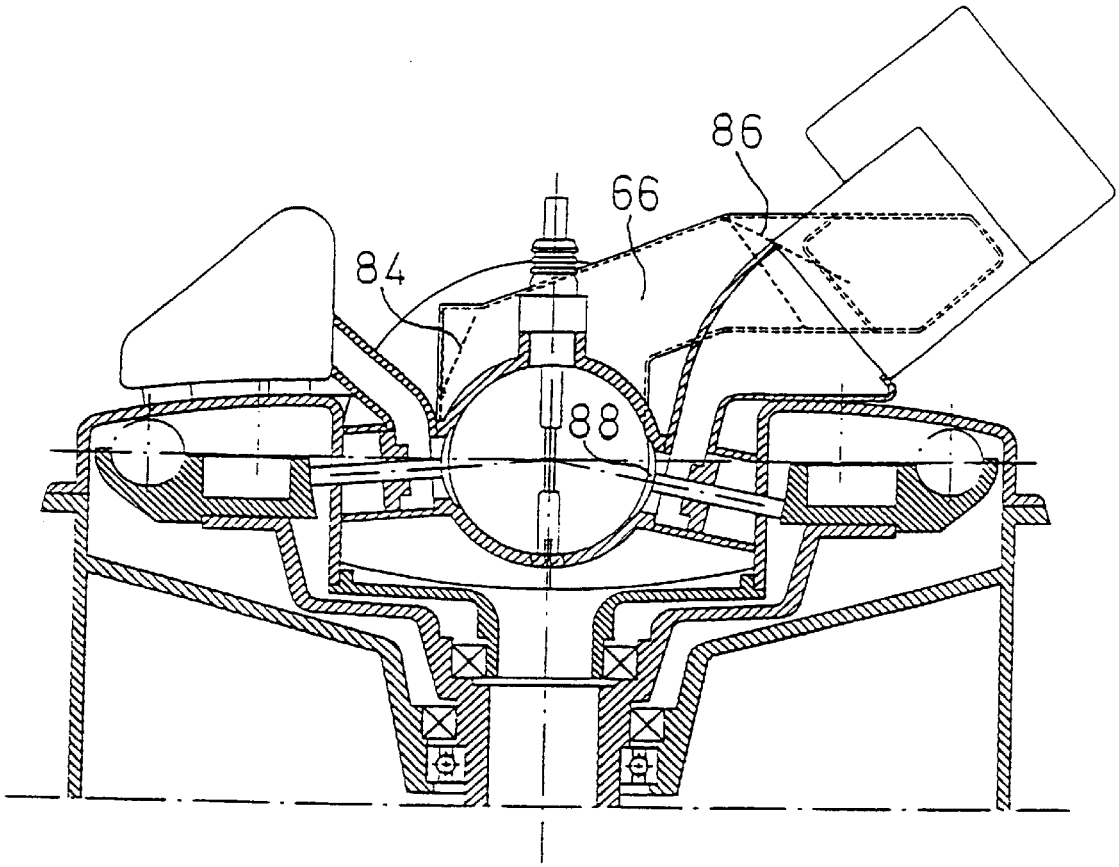
Figure 9:
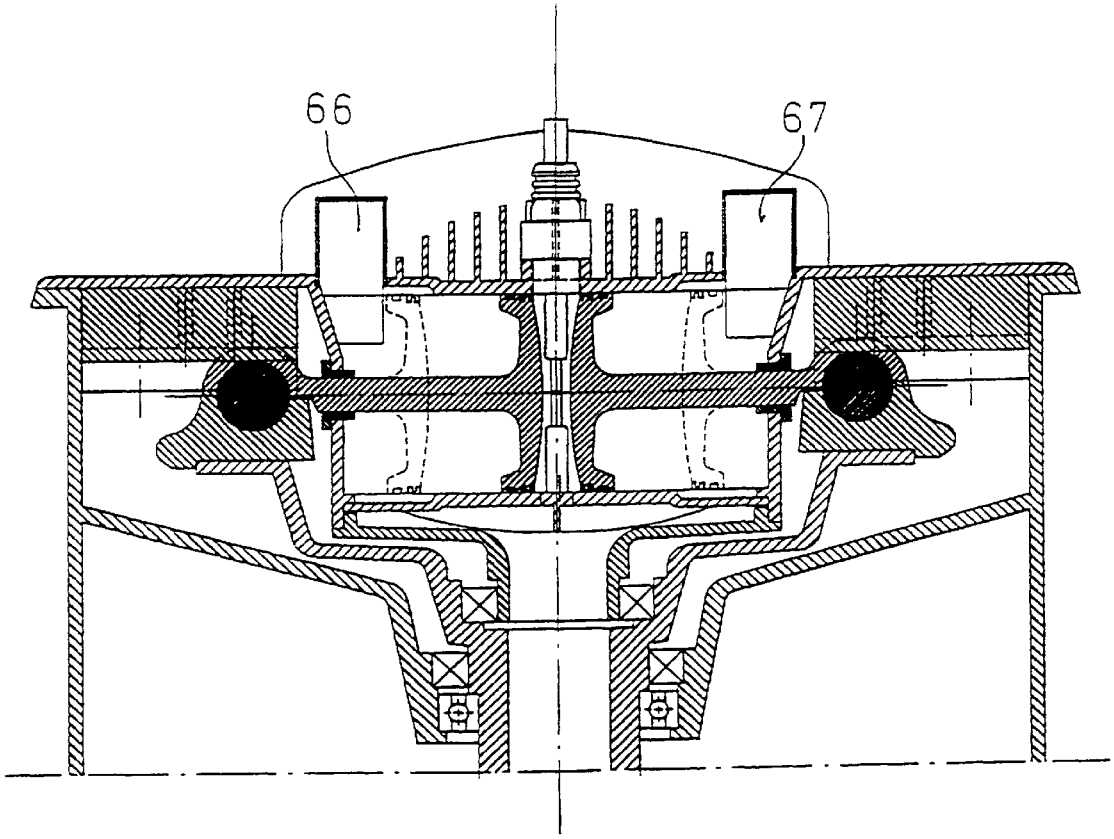

FIGS. 7–9 in a corresponding way show an application of the invention to a fourstroke engine. In this embodiment there are in each of the channels 66, 67 two reed-valves 84, 86 and 85, 87 respectively, the open and closed positions of which are shown with hatched lines in FIG. 8. When the pistons move towards the centre of the cylinder and the UDC air is suctioned in through the valves 84, 85 which operate as inlet valves. During the return movement of the pistons these valves are closed and the air is compressed. Air or air-fuel-mixture is supplied to the combustion chamber through the valve 88 in the cylinder wall which is arranged for this purpose. Thereby that the air is separated from the lubricated space of the engine it can be directly used when the system described works as an overpressure fed engine.

What is claimed is:

1. A power machine comprising:

a cylinder having a bore formed therein;

two pistons, each having a respective piston head and a piston rod connected thereto, said pistons being disposed in said bore with said piston heads in opposed facing relation with respect to each other with said respective piston rods extending in opposite directions and being constructed and arranged to synchronously reciprocate within said bore in opposite respective directions;

a transmission mechanism for converting linear reciprocating movement of said two pistons into a rotating movement;

structure defining a generally enclosed space on a piston rod side of each of said piston heads outside a range of motion of each of said piston heads; and a closing mechanism associated with each said space and constructed and arranged to close said space during at least a portion of each cycle of operation of said piston, each of said closing mechanisms comprising at least one valve for opening or closing said generally enclosed space.

2. A power machine according to claim 1, further comprising grooves formed in an interior wall defining said bore, at least one of said grooves being positioned near a lower dead center position of the range of motion of each of said pistons to thereby provide open connection between said generally enclosed space on the piston rod side of said piston head and a space on an opposite side of piston head when said piston head is in said lower dead center position.

3. A power machine according to claim 2, wherein said at least one groove is oriented at an angle to a longitudinal axis of said bore.

4. A power machine according to any of claims 1–3, wherein said generally enclosed space is constructed and arranged to effect compression of air or a fuel-air mixture in cooperation with each of said pistons, said air or fuel-air mixture being supplied into said bore after the compression thereof.

* * * * *